US011499371B2

(12) United States Patent
Skelborn

(10) Patent No.: US 11,499,371 B2
(45) Date of Patent: Nov. 15, 2022

(54) LADDER SUPPORT

(71) Applicant: Dylan Skelhorn, Glasgow Central (GB)

(72) Inventor: Dylan Skelborn, Glasgow Central (GB)

( * ) Notice: Subject to any disclaimer, the term of this patent is extended or adjusted under 35 U.S.C. 154(b) by 216 days.

(21) Appl. No.: 16/620,476

(22) PCT Filed: Jun. 6, 2018

(86) PCT No.: PCT/GB2018/051549
§ 371 (c)(1),
(2) Date: Dec. 6, 2019

(87) PCT Pub. No.: WO2018/224832
PCT Pub. Date: Dec. 13, 2018

(65) Prior Publication Data

US 2020/0095827 A1 Mar. 26, 2020

(30) Foreign Application Priority Data

Jun. 7, 2017 (GB) ..... 1709044

(51) Int. Cl.
*E06C 7/42* (2006.01)
*E06C 7/00* (2006.01)

(52) U.S. Cl.
CPC ..... *E06C 7/426* (2013.01); *E06C 7/003* (2013.01)

(58) Field of Classification Search
CPC . E06C 7/426; E06C 7/42; E06C 7/423; E06C 7/44; E06C 7/003

(Continued)

(56) References Cited

U.S. PATENT DOCUMENTS 4,679,652 A * 7/1987 Cervantes, Sr. ..... E06C 7/426 182/200
4,846,305 A * 7/1989 Kupfert ..... E06C 7/42 182/109

(Continued)

FOREIGN PATENT DOCUMENTS

AU 2011253570 A1 6/2013
GB 2286621 A 8/1995

(Continued)

OTHER PUBLICATIONS

International Search Report and Written Opinion of the International Searching Authority dated Aug. 21, 2018 in corresponding International Application No. PCT/GB2018/051549, 9 pages.

(Continued)

*Primary Examiner* — Daniel P Cahn
*Assistant Examiner* — Shiref M Mekhaeil
(74) *Attorney, Agent, or Firm* — MH2 Technology Law Group LLP

(57) ABSTRACT

The invention relates to a ladder stabiliser that obviates the existing requirement for a leaning ladder to be physically secured to a building and/or "footed" near the ground by a second person. The stabiliser comprises a base (12) for supporting, in use, both feet of a ladder (100); and upstanding walls (14, 16, 18, 20) defining an open-topped three-dimensional space for accommodating, and at least partially enclosing, the lower distal ends of a ladder (100) at a predetermined optimum angle of inclination. At least one wall (14, 16, 18, 20) extends above the height of the lowermost rung of an inclined ladder (100). A pivotable wall (18) is openable to allow the ladder (100) to be inserted and removed from the stabiliser. The stabiliser may be provided with removable ballast weights (30), and adjustable clamps (36).

21 Claims, 7 Drawing Sheets

(58) Field of Classification Search
USPC ..... 182/179.1, 180.1, 180.2, 107, 108, 109
See application file for complete search history.

(56) References Cited

U.S. PATENT DOCUMENTS 6,044,929 A * 4/2000 Wishner ..... E06C 7/426 248/188.4
6,053,284 A * 4/2000 Fountain ..... E06C 7/423 182/180.2
6,378,656 B1 * 4/2002 Kohler ..... E06C 7/44 182/129
6,547,036 B1 * 4/2003 Carter ..... E06C 7/426 182/200
8,042,651 B1 * 10/2011 Michnik ..... E06C 7/426 182/108
8,382,056 B2 * 2/2013 Le Masurier ..... E06C 7/426 248/346.03
8,393,586 B1 * 3/2013 Mercure ..... E06C 1/22 248/188.5
9,810,023 B2 * 11/2017 Stewart ..... E06C 7/42
10,815,729 B2 * 10/2020 Bowling ..... E06C 7/188
2002/0096395 A1 * 7/2002 Garrett ..... B27B 9/02 182/45
2002/0166723 A1 * 11/2002 Huber ..... E06C 7/42 182/127
2008/0105489 A1 * 5/2008 Garrett ..... E04G 3/26 248/237
2011/0012002 A1 * 1/2011 Masurier ..... E06C 7/426 248/346.03
2013/0119213 A1 * 5/2013 Watson ..... E06C 7/42 248/201
2015/0191975 A1 * 7/2015 Cox ..... B60D 1/66 280/491.2
2016/0348436 A1 * 12/2016 Reyes ..... F16M 11/38
2017/0198522 A1 * 7/2017 Stewart ..... E06C 7/42

FOREIGN PATENT DOCUMENTS

GB 2449728 A 12/2008
JP 2008179972 A 8/2008

OTHER PUBLICATIONS

Search Report dated Dec. 7, 2017 in corresponding GB Aplication No. 1709044.0, 1 page.
Combined Search and Examination Report issued in related GB Application No. 1809319.5, 6 pages.

* cited by examiner

LADDER SUPPORT

CROSS-REFERENCE TO RELATED APPLICATION(S)

This application is a national stage entry from International Application No. PCT/GB2018/051549, filed on Dec. 13, 2019, in the Receiving Office ("RO/IB") of Great Britain ("GB"), and published as International Publication No. WO 2018/224832 A1 on Dec. 13, 2018; International Application No. PCT/GB2018/051549 claims priority from Great Britain Patent Application No. 1709044.0, filed on Jun. 7, 2017, in the Great Britain Patent and Trademark Office ("GBPTO"), the entire contents of all of which are incorporated herein by reference.

The present invention relates to a ladder stabiliser and, particularly, but not exclusively, to a ladder stabiliser that obviates the existing requirement for a leaning ladder to be physically secured to a building and/or "footed" near the ground by a second person.

The use of ladders by employees is heavily regulated in the United Kingdom and governed by "The Work at Height Regulations 2005—Schedule 6 (Requirements for Ladders) ". According to the United Kingdom's Health and Safety Executive (HSE), not only are falls from ladders the leading category of "high fall" accidents, but they are also the primary source of fatalities. Guidance issued by the HSE states that ladders must be prevented from slipping during use by adopting one of the following options (presented in diminishing order of preference): (i) tying both stiles of the ladder to secure anchor points; (ii) using a ladder stability device; (iii) securely wedging the stiles of the ladder against a wall; and finally (iv) only if none of the foregoing is possible, "footing" of the ladder by a second person.

Whilst representing the preferred means of securing a ladder, option (i) above requires appropriate anchor points to be available or invasively installed, e.g. on a building facade, and so is often not desirable or practicable, particularly if—as is often the case—the job at hand requires regular movement of a ladder to a new position. As for option (ii), many existing stability devices provide only limited protection (as discussed further below) and require a degree of diligence on the part of the user for safe usage. Option (iii) is rarely available and, even when it is, it significantly constrains the placement of the feet of a ladder and its angle of inclination. For those reasons, the most commonly adopted option is footing of the ladder by a second person. However, human factors such as the tendency for a person to become distracted or complacent mean that this is an unreliable method of ensuring the safety of a person working at height.

Numerous forms of ladder stabilisers are already known which provide a simple base structure for engaging the feet of a ladder for the purpose of increasing surface area contact with the ground, and thereby reducing the likelihood of slippage. An example of such a stabiliser is disclosed in US patent publication No. US2009/0200110 (Donald Esselborn). However, stabilisers of this type are generally limited to preventing, or at least reducing, the tendency for the feet of a ladder to slip. They are generally ineffective in preventing the full range of unwanted ladder movements associated with "high fall" accidents. For example, lateral slippage of a ladder at its upper contact point, and flipping or pivoting of a ladder at its upper end each tend to cause one foot to disengage with the ground.

The present invention therefore seeks to provide an improved ladder stabiliser which addresses, or at least ameliorates, one or more of the aforementioned disadvantages by ensuring that a single person can safely use a ladder in all circumstances. In preferred embodiments, this is achieved whilst also satisfying existing legislative safety requirements.

According to the present invention, there is provided a ladder stabiliser comprising:

(i) a base for supporting, in use, both feet of a ladder; and (ii) at least two walls extending upwards from the base and defining, with the base, a first open-topped three-dimensional space for accommodating, and at least partially enclosing, the lower distal ends of a ladder, said three-dimensional space being defined, at least in part, by a substantially planar first wall extending upwards from the base;

wherein at least part of said first wall extends to a height above the base which, in use, is equal to, or greater than, that of the lowermost rung of an inclined ladder; and wherein the first wall is inclined at an angle of inclination with respect to the base for providing support, in use, to the rear surfaces of ladder stiles located within the first three-dimensional space.

It will be appreciated that an increased height of said at least one wall provides additional support to a ladder and reduces or eliminates unwanted movement of its lowermost distal ends. In a preferred embodiment, said at least one wall extends to a height above the base of at least 25 cm, this being the generally expected minimum spacing of ladder rungs. The first rung on a ladder will usually be located a distance of less than 25 cm from the ladder feet and so this wall height will, in the vast majority of cases, exceed the height of the lowermost ladder rung.

Optionally, said first three-dimensional space is defined, at least in part, by substantially planar spaced apart side walls each extending upwards from the base.

Optionally, the first wall extends between the spaced apart side walls.

Optionally, the angle of inclination of the first wall relative to the base is between 75 degrees and 77 degrees.

Preferably, the angle of inclination of the first wall relative to the base is 75.96 degrees.

It will be appreciated that an angle of inclination of 75.96 degrees corresponds to the optimum "1 in 4" gradient rule whereby for every four units of height to be climbed, the base of the ladder moves one unit out.

Optionally, a pair of laterally adjustable clamps are arranged within the first three-dimensional space for selectively engaging, in use, respective outer lateral side surfaces of ladder stiles.

Preferably, the laterally adjustable clamps are attached to the respective opposing side walls of the first three-dimensional space.

It will be appreciated that the lateral forces applied to the respective outer lateral side surfaces of ladder stiles will resist sideways movement of the ladder within a general plane lying parallel to that of the inclined first wall.

Optionally, said first three-dimensional space is defined, at least in part, by a substantially planar second wall extending upwards from the base.

Optionally, the second wall is spaced from the first wall and extends between spaced apart side walls extending upwards from the base.

Optionally, at least one of the respective side walls, the first wall and the second wall extends to a height above the base which is greater, in use, than that of the lowermost rung of an inclined ladder.

It will be appreciated the presence of the second wall will resist: (i) slippage of both ladder stiles in a direction away from the inclined first wall; and (ii) forward movement of a single ladder stile in a twisting movement away from general plane of the inclined first wall.

Optionally, the second wall has a hinged connection with the base and is moveable between an open and closed positions.

Alternatively, the second wall has a hinged connection with one of the side walls and is moveable between open and closed positions.

Optionally, a lock is provided for selectively securing the second wall in the closed position.

It will be appreciated that the open position of the second wall facilitates movement of a ladder into and out of the first three-dimensional space. When in the closed position, the second wall is inclined relative to the base, its angle of inclination being substantially equal to that of the first wall. The first and second walls and the side walls together delineate a rectangular shape in cross-section through a plane parallel to the base.

Optionally, a central recessed portion is formed in the first wall.

Optionally, the central recessed portion is provided with a base, opposing side walls and a rear wall.

Optionally, a central cut-out portion is provided on the second wall to generally coincide with the central recessed portion formed in the first wall.

It will be appreciated that the two lateral inclined faces of the first wall either side of the central recessed portion are arranged to coincide with the position of the spaced stiles of a ladder when it is located within the first three-dimensional space; and the central recessed portion is dimensioned to accommodate the part of a user's foot which, during use, extends beyond the lowermost rung of a ladder.

Optionally, a substantially planar third wall extends upwards from the base.

Optionally, the third wall is spaced from the first wall and extends between the spaced apart side walls.

Optionally, a second open-topped three-dimensional space is defined by the spaced apart first and third walls, and the spaced apart side walls.

Optionally, at least one removable ballast weight is receivable within the second three-dimensional space.

It will be appreciated that the cumulative weight of the ballast within the second three-dimensional space will be sufficient to anchor the ladder stabiliser and its associated ladder. The particular weight required to do so may vary dependent on various factors including the height of the ladder, the weight of the user and any materials being carried. Conveniently, the cumulative overall ballast weight may be distributed between multiple ballasts of lesser individual weight. An optimum weight for each individual ballast will be no more than 25 kg which is generally accepted as being the maximum safe weight to be carried manually by a male.

Optionally, height-adjustable feet are connected to the base and/or side walls for levelling the ladder stabiliser before use.

Optionally, the height-adjustable feet are located at fixed positions proximate each corner of the base and/or side walls.

Alternatively, the height-adjustable feet are provided on struts which are pivotably deployable away from each side wall.

Optionally, a fourth wall is spaced from the third wall and extends between the spaced apart side walls to define a third open-topped three-dimensional space.

The third open-topped three-dimensional space may be used as a storage space. By way of example only, the third open-topped three-dimensional space may be used to store collapsible fluorescent warning cones for placement around the ladder stabiliser during use.

Optionally, at least two spirit levels are provided on at least two of the respective side walls, the first wall, the second wall, the third wall, and the fourth wall for indicating the inclination of the ladder stabiliser in two perpendicular directions.

Optionally, drainage holes are provided in the base.

Optionally, graspable handles are formed in, or attached to, at least the side walls to facilitate lifting and manoeuvring of the ladder stabiliser.

Further features and advantages of the present invention will become apparent from the claims and the following description.

Embodiments of the present invention will now be described, by way of example only, with reference to the following diagrams, in which:—

Figure 1:
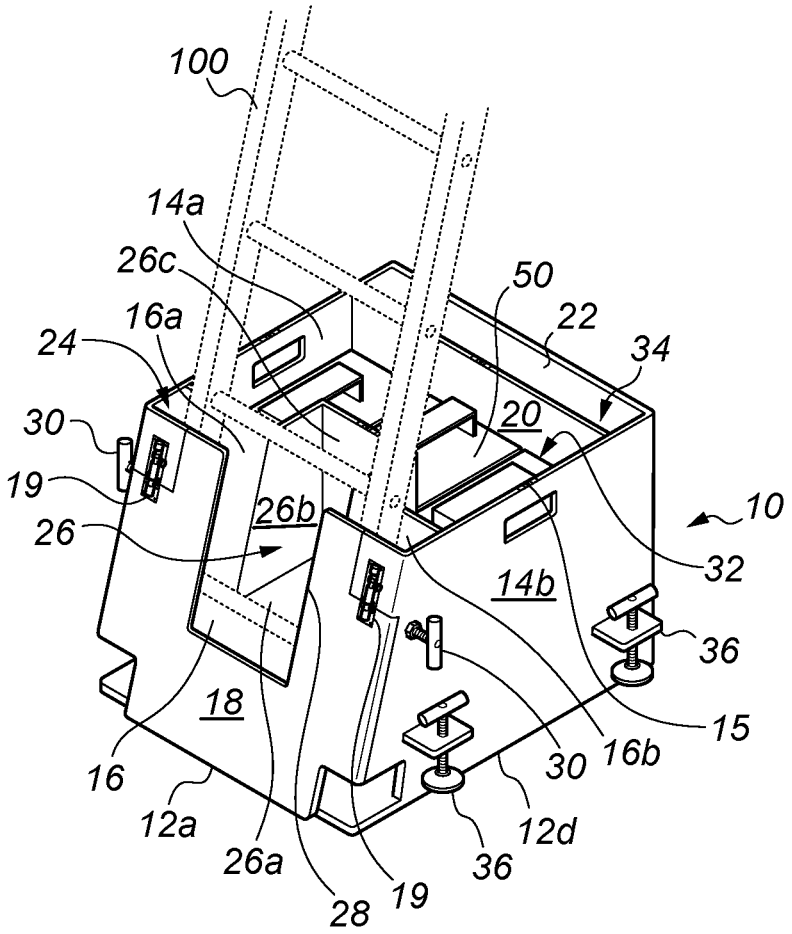
FIG. 1 is a schematic perspective view of a ladder stabiliser according to a first embodiment of the present invention with a ladder represented in phantom lines in-situ within its first open-topped three-dimensional space.
Figure 2:
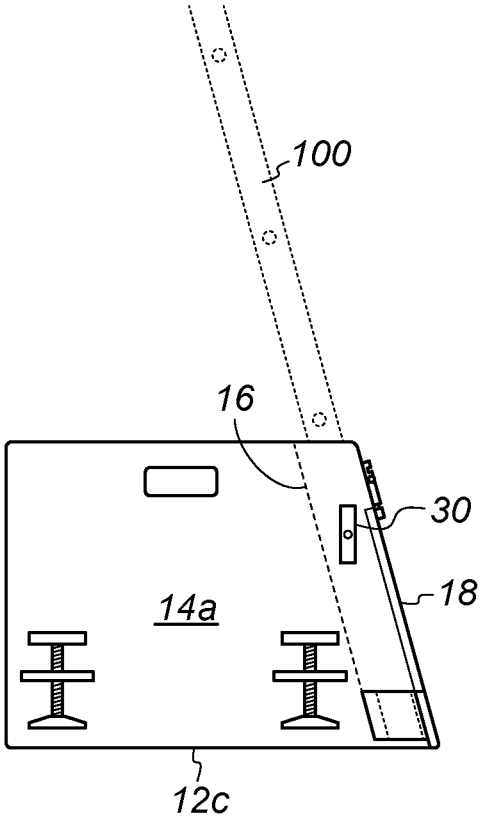
FIG. 2 is a schematic side view of the ladder stabiliser of FIG. 1.
Figure 4A:
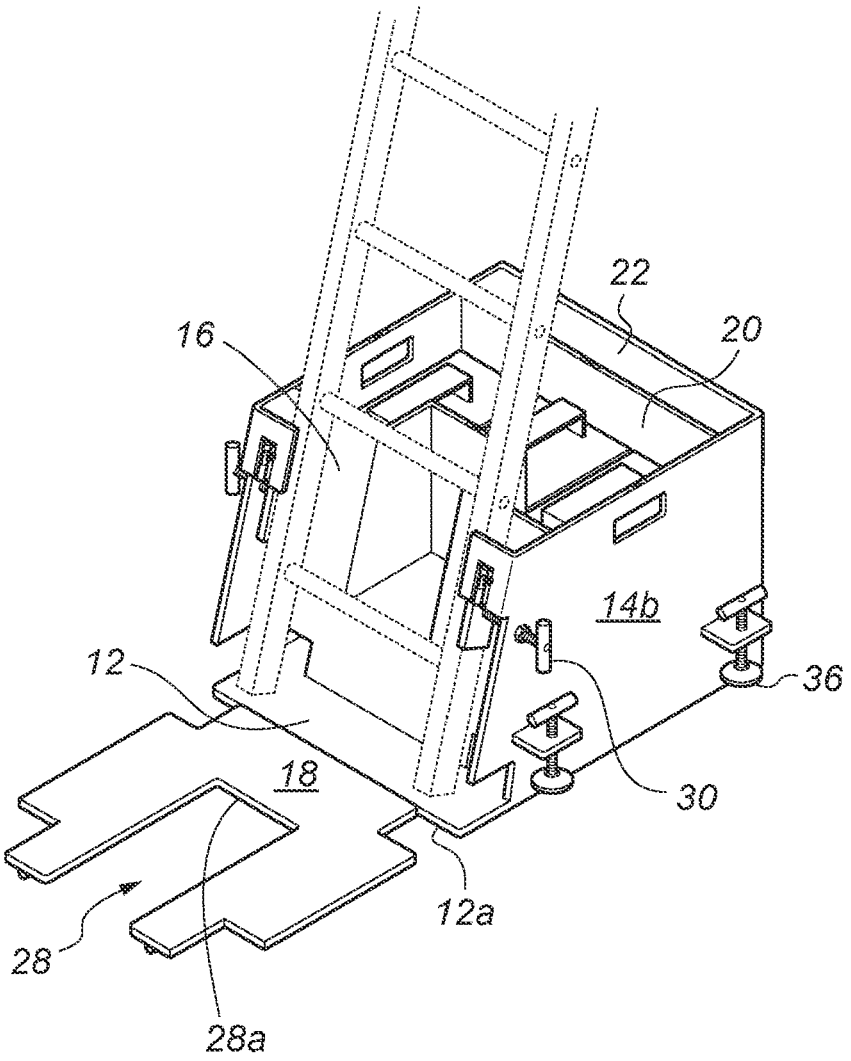
Figure 4B:
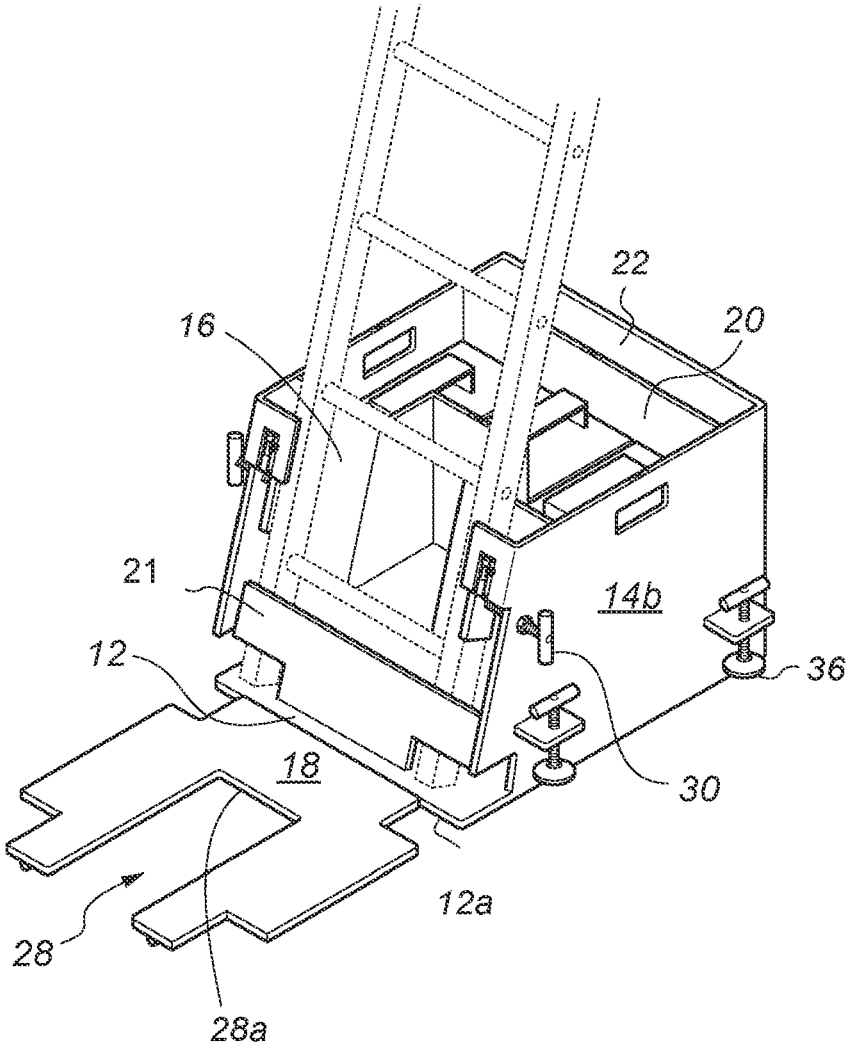
Figure 5A:
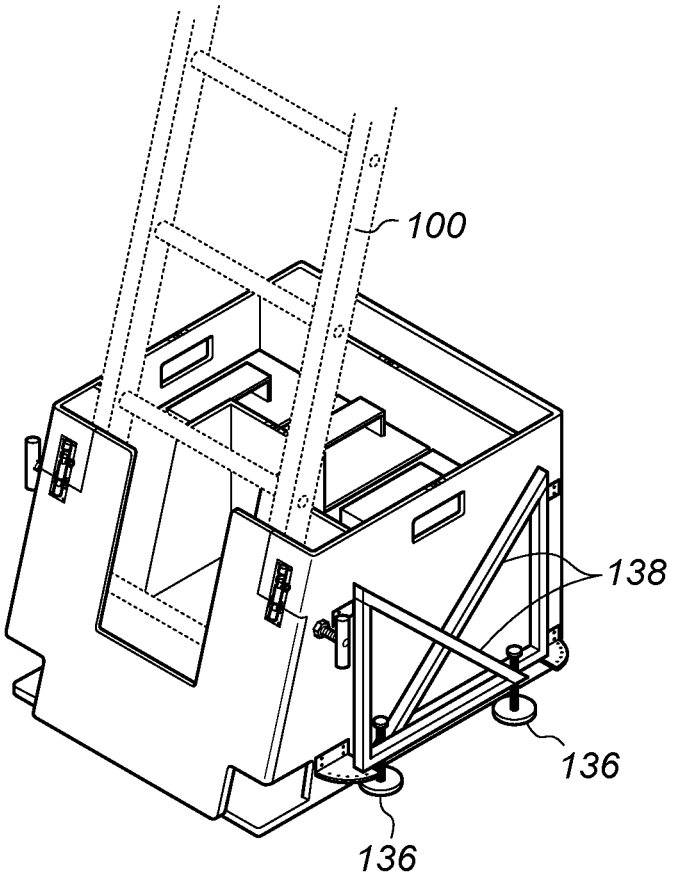
Figure 5B:
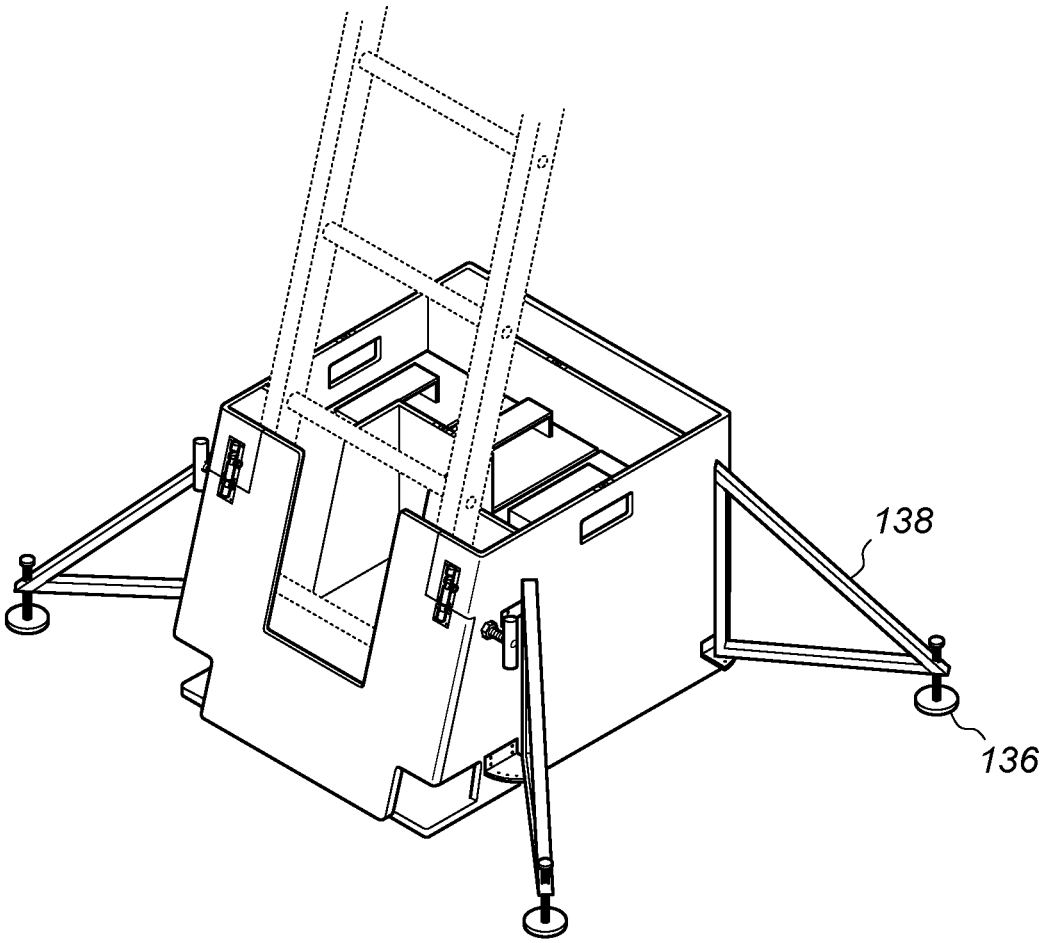

FIG. 4*a* is a schematic perspective view of the ladder stabiliser of FIG. 1 with its second wall in its open condition to facilitate insertion and removal of a ladder into the first three-dimensional space;

FIG. 4*b* is a schematic perspective view of a modified version of the ladder stabiliser of FIG. 4*a* comprising an adjustable bracing member for engaging the front surfaces of the lowermost ends of ladder stiles;

FIG. 5*a* is a schematic perspective view of a ladder stabiliser according to a second embodiment of the present invention showing its adjustable feet in their collapsed positions; and FIG. 5*b* is a schematic perspective view of the ladder stabiliser of FIG. 5*a* showing its adjustable feet in their deployed positions.

As shown in FIG. 1, the ladder stabiliser of the present invention takes the form of a box-like structure 10 comprising: a planar, rectangular base 12 (see FIGS. 4*a*, 4*b*) having front, rear, and opposite side peripheral edges 12*a-d*; two planar side walls 14*a*, 14*b* extending vertically from the opposite side peripheral edges 12*c*, 12*d* of the base 12; a first planar wall 16 extending upwards from the base 12 at an inclined angle, and extending between the side walls 14*a*, 14*b* at a position proximate, but spaced from the front peripheral edge 12*a*; a second planar wall 18 pivotably attached to the base 12 at its front peripheral edge 12*a*, and extending between the side walls 14*a*, 14*b*; a third planar wall 20 extending vertically from the base 12, and extending between the side walls 14*a*, 14*b* at a position proximate, but spaced from and parallel to the rear peripheral edge 12*b*; and a fourth planar wall 22 extending vertically from the base 12 at its rear peripheral edge 12*b*, and extending between the side walls 14*a*, 14*b*.

The second wall 18 is pivotable between a fully open position (see FIG. 4*a*) in which it extends substantially parallel to the base 12; and a fully closed position (see FIG.

2) in which it extends at an inclined angle which is substantially equal to that of the first wall 16. A pair of locks 19 is provided for locking the second wall 18 in the closed position.

A first open-topped three-dimensional space 24 is defined between the internal surfaces of: the base 12, the first and second inclined walls 16, 18, and the vertical side wall portions 14*a*, 14*b*. The first and second walls 16, 18, and the side walls 14*a*, 14*b* each extend to a vertical height above the base 12. In a preferred embodiment the vertical height is at least 25 cm. It will be appreciated that this height will, in the vast majority of cases, be greater than the height of the first rung of a standard ladder 100 (shown in phantom lines) when arranged, in use, at its optimal angle of inclination. The first wall 16 is inclined at an angle of inclination relative to the base 12 which accords with the "1 in 4" gradient rule governing the optimal position for safe ladder use.

The first wall 16 is provided with a central recess 26 which causes its surface to adopt a general U-shape. The central recess 26 is provided with a base 26*a*, opposing side walls 26*b*, and a rear wall 26*c*. Inclined surface portions 16*a*, 16*b* are located at either side of the central recess 26. A central cut-out portion 28 is provided in the second wall 18, the side walls of which generally coincide and align with those of the central recess 26 formed in the first wall 16. The lowermost edge 28*a* of the central cut-out portion 28 may be arranged to be marginally lower than the base 26*a* of the central recess 26 within the first wall 16 to provide a degree of clearance for a user's foot as it is placed on, and removed from, the lowermost rung during use of the ladder 100.

A pair of laterally adjustable clamps 30 are attached to the opposing side wall portions 14*a*, 14*b* within the first three-dimensional space 24. In the alternative embodiment of FIG. 4*b*, a detachable and adjustable bracing member 21 is provided within the first open-topped three-dimensional space 24 proximate the base 12. The bracing member 21 is generally T-shaped to thereby match the outline shape of the lower part of the pivotable wall 18; and is inclined to match the angle of inclination of the first wall 16 and the pivotable wall 18. The bracing member 21 is securable to the inclined first wall 16. The spacing of the bracing member 21 from the inclined first wall 16 may be adjusted by, for example, screw threads (not shown) which extend through apertures (not shown) provided in the inclined first wall 16 and fastened behind it with wing nuts (not shown).

Figure 3:
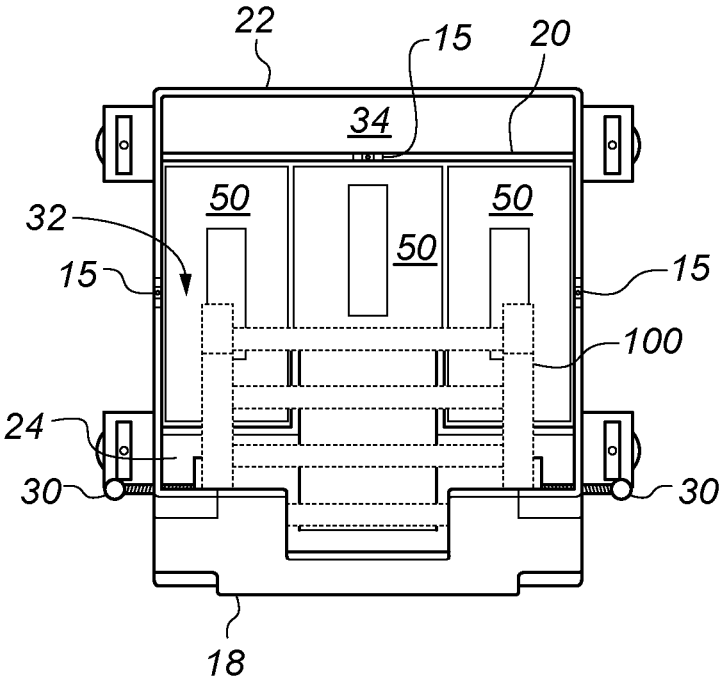
FIG. 3 is a schematic plan view of the ladder stabiliser of FIG. 1.

As best shown in FIG. 3, a second open-topped three-dimensional space 32 is defined between the internal surfaces of: the base 12, the first inclined wall 16, the third vertical wall 20, and vertical side wall portions 14*a*, 14*b*. A third open-topped three-dimensional space 34 is defined between the internal surfaces of: the base 12, the third and fourth vertical walls 20, 22, and vertical side wall portions 14*a*, 14*b*.

In the embodiments shown in FIGS. 1 to 4*b* there is provided four height-adjustable feet 36 proximate each lower corner of the box-like structure 10. The height-adjustable feet 36 are each attached to a side wall 14*a*, 14*b* at a position above its lowermost edge such that they may be vertically retracted and extended above and below the height of the base 12.

In the alternative embodiment of FIGS. 5*a* and 5*b*, the four height-adjustable feet 136 are attached to elongate triangular struts 138 which are pivotably deployable between: (i) a collapsed/folded position (see FIG. 5*a*) whereby they are arranged to overlap and lie substantially parallel to their respective side walls 14*a*, 14*b*; and (ii) an extended position (see FIG. 5*b*) whereby they are pivoted away from their respective side walls 14*a*, 14*b*.

In use, the ladder stabiliser 10 is positioned proximate a working site in accordance with the aforementioned "1 in 4" rule. Once manoeuvred into its approximate position, ballast weights 50 are introduced into the second open-topped three-dimensional space 32 to anchor the ladder stabiliser 10 in position. The user may then view the spirit levels 15 provided at the upper edges of the side walls 14*a*, 14*b* and the third vertical wall 20 to determine whether the ladder stabiliser 10 is level on the ground. If not, appropriate adjustments are made to the height-adjustable feet 36 to level the ladder stabiliser 10. In the embodiment of FIGS. 5*a* and 5*b*, the triangular struts 138 are first deployed by pivoting them away from the respective side walls 14*a*, 14*b* before effecting any adjustments via the height-adjustable feet 136.

Once the ladder stabiliser 10 is anchored in position the locks 19 on its second wall 18 are disengaged and it is pivoted to open so as to lie in substantially the same plane as the base 12. The ladder stabiliser 10 is now ready to receive a ladder 100. Provided that there is sufficient space, a ladder 100 is positioned horizontally with its feet placed against, or proximate to, the first wall 16. The ladder 100 is then raised from its opposite end such that the lowermost ends of its stiles lie proximate to, or rest against, the inclined first wall 16; and the uppermost ends of its stiles lie against a supporting surface, e.g. a building wall. At this point the user should verify that the ladder stabiliser remains secure and level, and that the "1 in 4" spacing rule is being satisfied. If not, any necessary adjustments to the ladder length and/or positioning or levelling of the ladder stabiliser 10 can be made.

The second wall 18 is pivoted to its closed position and the locks 19 are re-engaged. The lowermost end of the ladder 100 is thereby enclosed within the first open-topped three-dimensional space 24 with its lowermost rung extending across the cut-out portion 28 formed within the second wall 18.

Finally, the clamps 30 are manually tightened against the two outer side surfaces of the ladder stiles within the first open-topped three-dimensional space 24. The ladder 100 may now be used safe in the knowledge that the first, second and side walls 16, 18, 14*a*, 14*b*, in combination with the clamps 30, will prevent the full range of unwanted ladder movements associated with "high fall" accidents, i.e. including lateral slippage of a ladder at its upper contact point, and flipping or pivoting of a ladder at its upper end each tend to cause one foot to disengage with the ground.

In the modified embodiment of FIG. 4*b*, the bracing member 21 may, if necessary, be attached and moved in the direction of the inclined first wall 16 to take up any free space between the pivotable wall 18 and the front surfaces of the ladder stiles. Once secured in place, the bracing member 21 provides additional support against unwanted ladder movement that may otherwise arise when, for example, smaller sized ladders 100 are used. The ladder stabiliser of the present invention is therefore entirely universal and suitable for use in any industry sectors and countries, irrespective of ladder types and dimensions.

A user may, by virtue of the central recess 26 and central cut-out portion 28, place his/her foot onto the lowermost ladder rung within the first open-topped three-dimensional space 24 and proceed to climb the ladder. When doing so, the rear surfaces of the ladder stiles are supported by the two lateral inclined portions of the first wall 16; the outside surfaces of the ladder stiles are supported by clamps 30; and significant movement of the ladder away from a supporting surface (such as a building wall) is prevented by the second wall 18. Accordingly, unwanted movement of the ladder is prevented, or at least significantly inhibited, in all directions.

Although particular embodiments of the invention have been disclosed herein in detail, this has been done by way of example and for the purposes of illustration only. The aforementioned embodiments are not intended to be limiting with respect to the scope of the appended claims. It is contemplated by the inventor that various substitutions, alterations, and modifications may be made to the invention without departing from the scope of the invention as defined by the claims.

Examples of these include, for example, drainage holes may be provided in the base 12 to allow the escape of rainwater. Graspable handles may be attached to or—as shown in the figures—formed in the side walls 14*a*, 14*b* to facilitate lifting and manoeuvring of the ladder stabiliser.

In order to accommodate certain types of ladders having enlarged foot portions extending perpendicularly with respect to the stiles, suitable sized apertures may be formed proximate the lower corners of the first and second walls 16, 18 and the side walls 14*a*, 14*b*, as illustrated in the figures. This will ensure that the ladder stabiliser 10 is able to accept different foot structures.

In order to accommodate ladders having different stile thicknesses, the ladder stabiliser 10 may be provided with a set of spacers (not shown) which can be introduced into the first open-topped three-dimensional space 24 to fill any gaps in front of and/or behind the stiles. This will ensure that the ladder stabiliser 10 is able to secure all ladders against unwanted movement in a direction perpendicular to the plane of the first wall 16 irrespective of stile thickness. The spacers may be stored inside the third open-topped three-dimensional space 34 when not in use.

In one embodiment (not shown), a strap and buckle arrangement is attached to the first wall 16 proximate the likely position of the lowermost rung of the ladder 100. This may be used to secure the lowermost rung and prevent it from "kicking up" should it become top heavy as it is raised into position against a supporting surface.

Finally, full opening of the second wall may be inhibited by the presence of the locks 19 on the outside of the second wall 18. This may impede the process of positioning a ladder 100 into the ladder stabiliser 10. Accordingly, in addition to the height adjustable feet 36, 136 shown in the figures, further fixed feet (not shown) may be provided on the underside of the base 12 for the purpose of raising the base above the ground by a distance which is at least equal to the depth distance of the locks 19. This will ensure that the second wall 18 can always be opened to be at least parallel with the base 12.

The invention claimed is:

1. A ladder stabilizer comprising:

(i) a base for supporting, in use, both feet of a ladder; and (ii) at least a first wall and a second wall that both extend upwards from the base and defining, with the base, a first open-topped three-dimensional space for accommodating, and at least partially enclosing, lower distal ends of the ladder, said first open-topped three-dimensional space being defined, at least in part, by the first wall that is a substantially planar first wall extending upwards from the base, and at least in part by the second wall that is a substantially planar second wall extending upwards from the base;

wherein the ladder comprises rungs spaced from each other by at least 25 cm, and wherein at least part of the first wall extends to a vertical height above the base which, in use, is equal to, or greater than 25 cm to extend above the height of a lowermost rung of the ladder when inclined; wherein the first wall is inclined at an angle of inclination with respect to the base for providing support, in use, to at least one rear surface of at least one ladder stile located within the first open-topped three-dimensional space; and wherein the second wall has a hinged connection with the base and wherein the second wall is moveable between a fully open position in which the second wall extends substantially coplanar with the base, and a fully closed position in which the second wall extends at an inclined angle which is substantially parallel to the angle of inclination of the first wall.

2. The ladder stabilizer according to claim 1, wherein said first three-dimensional space is further defined by two substantially planar spaced apart side walls each extending upwards from the base.

3. The ladder stabilizer according to claim 2, wherein the first wall extends between the two substantially planar spaced apart side walls each extending upwards from the base.

4. The ladder stabilizer according to claim 2, wherein the second wall is spaced from the first wall and extends between the two substantially planar spaced apart side walls extending upwards from the base.

5. The ladder stabilizer according to claim 2, wherein a third wall extends upwards from the base.

6. The ladder stabilizer according to claim 5, wherein the third wall is spaced from the first wall and extends between the two substantially planar spaced apart side walls.

7. The ladder stabilizer according to claim 5, wherein a second open-topped three-dimensional space is defined by the spaced apart first and third walls, and the spaced apart side walls.

8. The ladder stabilizer according to claim 7, wherein at least one removable ballast weight is receivable within the second three-dimensional space.

9. The ladder stabilizer according to claim 5, wherein a fourth wall is spaced from the third wall and extends between the spaced apart side walls to define a third open-topped three-dimensional space.

10. The ladder stabilizer according to claim 9, wherein at least two spirit levels are provided on at least two of the respective side walls, the first wall, the second wall, the third wall, and the fourth wall for indicating the inclination of the ladder stabiliser in two perpendicular directions.

11. The ladder stabilizer according to claim 1, wherein the angle of inclination of the first wall relative to the base is between 75 degrees and 77 degrees.

12. The ladder stabilizer according to claim 11, wherein the angle of inclination of the first wall relative to the base is 75.96 degrees.

13. The ladder stabilizer according to claim 1, wherein a pair of laterally adjustable clamps are arranged within the first three-dimensional space for selectively engaging, in use, respective outer lateral side surfaces of ladder stiles.

14. The ladder stabilizer according to claim 13, wherein the laterally adjustable clamps are attached to a pair of substantially planar spaced apart side walls of the first three-dimensional space.

15. The ladder stabilizer according to claim 1, wherein at least one of respective side walls, the first wall and the second wall extends to a height above the base which is greater, in use, than that of the lowermost rung of the ladder.

16. The ladder stabilizer according to claim 1, wherein a lock is provided for selectively securing the second wall in the closed position.

17. The ladder stabilizer according to claim 1, wherein a central recessed portion is formed in the first wall.

18. The ladder stabilizer according to claim 17, wherein the central recessed portion is provided with a base, opposing side walls and a rear wall.

19. The ladder stabilizer according to claim 17, wherein a central cut-out portion is provided on the second wall to generally coincide with the central recessed portion formed in the first wall.

20. The ladder stabilizer according to claim 1, wherein height-adjustable feet are connected to the pair of substantially planar spaced apart side walls for levelling the ladder stabiliser before use.

21. The ladder stabilizer according to claim 20, wherein the height-adjustable feet are located at fixed positions proximate each corner of the base and/or side walls.

* * * * *